United States Patent [19]

Collins

[11] Patent Number: 4,649,912

[45] Date of Patent: Mar. 17, 1987

[54] SUPPLIED AIR RESPIRATOR SYSTEM

[76] Inventor: William C. Collins, 132 Auglin La., Jackson, Tenn. 38301

[21] Appl. No.: 731,714

[22] Filed: May 7, 1985

[51] Int. Cl.[4] ..... A62B 7/00

[52] U.S. Cl. ..... 128/202.13; 128/205.17; 128/205.25; 128/205.12

[58] Field of Search ..... 128/205.24, 204.25, 128/204.21, 205.25, 207.18, 207.16, 207.14, 205.17, 204.18, 205.13, 205.12, 205.27, 205.29, 202.13

[56] References Cited

U.S. PATENT DOCUMENTS

| | | | |
|---|---|---|---|
| 1,288,647 | 12/1918 | Miller | 128/205.12 |
| 2,348,074 | 5/1944 | Lambertsen | 128/205.25 |
| 2,642,061 | 6/1953 | Boyer | 128/205.29 |
| 2,775,968 | 1/1957 | Polli et al. | 128/205.12 |
| 3,796,216 | 3/1974 | Schwarz | 128/205.13 |
| 4,119,097 | 10/1978 | Spector | 128/205.25 |
| 4,440,163 | 4/1984 | Spengel | 128/205.13 |

FOREIGN PATENT DOCUMENTS

| | | | |
|---|---|---|---|
| 23059 | 10/1929 | Australia | 128/202.13 |
| 466452 | 7/1950 | Canada | 128/202.13 |
| 1320829 | 2/1963 | France | 128/205.12 |

*Primary Examiner*—Henry J. Recla

*Attorney, Agent, or Firm*—Luedeka & Neely

[57] ABSTRACT

The specification discloses a supplied air respirator system for delivering air to a painter who is using a compressed air line leading to a hand-held paint spray unit. A supply tap is located in the compressed air line for removing a supply of compressed air for delivery to the painter. The tap is located in the compressed air line proximate to the hand-held paint spray unit and is configured to be oriented generally vertically above the air line so that the tendency of particles to be drawn into the tap is reduced. A valve connected to the tap is configured to be controlled by the painter for selectively removing a supply of air from the compressed air line. A delivery tube delivers air to the painter from the valve and a filter located in the delivery tube removes particulates out of the air taken from the air line. The delivery tube is connected to a mask worn by the painter for receiving and containing the air. A bag attached to the mask is configured to receive the air entering the mask from the delivery tube to provide a reservoir of air for the mask. A diverter is located wherein the delivery tube enters the mask to divert the flow of fluid in the direction of the bag so that condensate or particles in the air are deposited into the bag before the air passes into the mask.

6 Claims, 8 Drawing Figures

SUPPLIED AIR RESPIRATOR SYSTEM

This invention relates to respirators and more specifically relates to a respirator system for use in paint spray applications which provides air to a painter who is using a hand-held paint sprayer powered by a supply of compressed air.

Respirators are commonly used by workers in environments where contaminants in the ambient air make breathing the air dangerous or irritating. Such respirators vary considerably and range from simple cotton masks to completely self enclosed suits with built-in air supplies. Simple mask-type respirators are essentially filters and serve to remove a broad array of suspended particulates from the air before it is inhaled. Respirators with built-in air supplies do not filter ambient air, but instead relay on a source of preconditioned air.

Exposure to paint particles and vapors commonly present in paint spray booths can have serious health consequences, and workers who paint automobiles in closed booths are generally required to use some type of mask. Painters most frequently use a filter mask that seals over the nose and mouth of the painter and filters ambient air. The vacuum of the painter's breath is used to draw the air through the filters.

One problem with a filter type mask is that modern paints create fumes of gases and particulate that are very difficult to filter and many filters that were once useful in a spray paint mask are now totally inadequate. Another problem with filter masks is that the filters clog. In many cases, the filters clog because a painter cannot afford to replace his filters as often as necessary, so he uses a clogged or partially clogged filter. When this happens, the vacuum created by the painter's breath will often break the seal of the mask against the face and the painter will inhale ambient air and paint through and around the edges of the mask. In such cases, the mask is providing a false sense of protection that is dangerous to the health of the painter.

Supplied air respirators are available but they are not used by many painters because of their expense and bulkiness. Such respirators usually have a separate and expensive air supply, such as bottled air or a so-called oil-less or oil free air compressor that injects only a relatively small amount of oil and water into the air as compared to typical air compressors. A painter who is manipulating an airline connected to his spray unit is disinclined to have yet another airline connected between another remote air supply and his face.

A need has thus arisen for a supplied air respirator system which can continuously deliver a supply of fresh air to a painter, and which addresses the problems of economy, effectiveness and portability.

The present invention meets this need and therefore solves the foregoing and other problems long associated with respirators used in paint spray applications by utlizing the compressed air already available for powering the paint sprayer in combination with structure to improve the quality of the compressed air and deliver it to the painter, thereby eliminating the need of an auxiliary air source or of the inconvenience of continually replacing mask filters.

In accordance with the present invention a supplied air respirator system is provided for delivering air to a painter who is using a compressed air line leading to a hand-held spray unit. The respirator system includes a supply tap located in the compressed air line for removing a supply of compressed air for delivery to the painter. The tap is located in the line proximate to the hand-held spray unit and is configured to be oriented generally vertically above the air line so that the tendency of particles (oil and water droplets) to be drawn into the tap is reduced. A valve in fluid flow communication with the tap is configured to be controlled by the painter for selectively removing a supply of air from the compressed air line. A delivery tube delivers air to the painter from the valve and a filter located in the delivery tube removes particulates out of the air. The delivery tube is in fluid flow communication with a mask to be worn by the painter for receiving and containing within the mask the air. A bag is sealably connected to the mask and in fluid flow communication therewith, and is configured to receive and contain air and condensate formed in the air entering the mask from the delivery tube and to provide an air reservoir for the mask.

The valve and tap are configured so that both can be held in a single hand and the valve can be manipulated by that single hand. Also, the mask includes exhaust ports and valves near the painter's eyes so that exhaust air tends to clear the ambient air around the eyes of the painter.

In accordance with another aspect of the present invention, a union is interposed between the mask and the delivery tube and is in fluid flow communication with the mask and delivery tube with the bag being sealably attached to the union. Structure located in the union diverts the flow of filtered air entering the union from the delivery tube in the direction of the bag to further facilitate depositing of condensate or other particles in the bag.

The advantages and further aspects of the present invention will be readily appreciated by those of ordinary skill in the art as the same becomes better understood by refererence to the following detailed description of a preferred embodiment when considered in conjunction with the accompanying drawings in which.

Figure 2A:
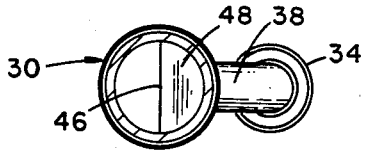
FIG. 2 is a cross-section view of a union for passing air from the delivery tube into the mask.
Figure 2:
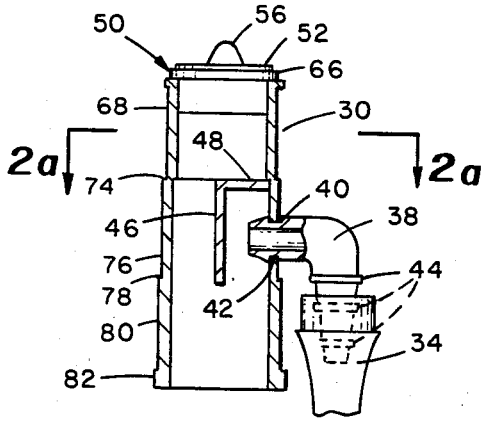
Figure 3:
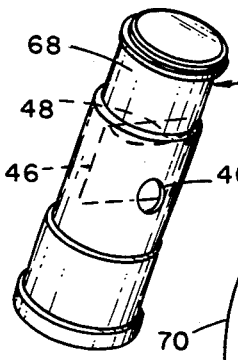
Figure 4A:
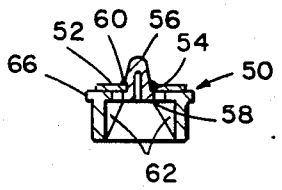
Figure 4:
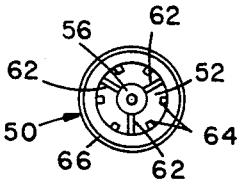
Figure 5:
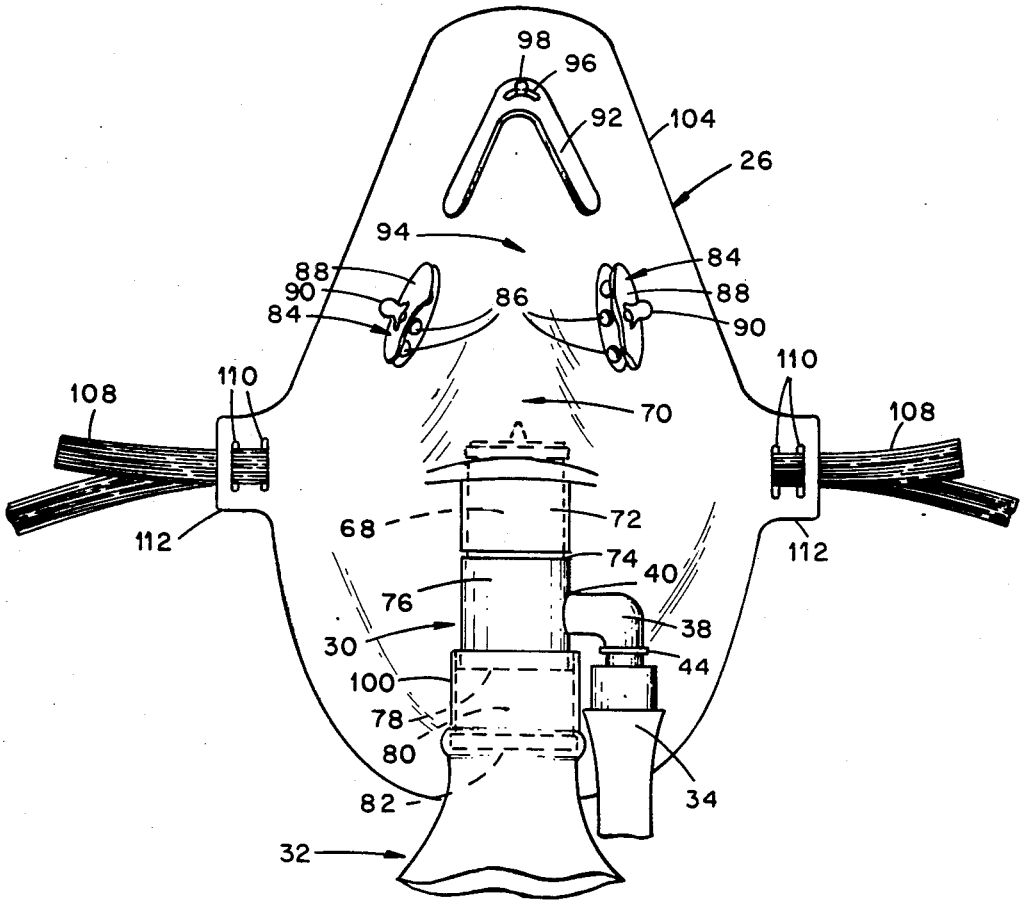

FIG. 2*a* is a top view of the union shown in FIG. 2;

FIG. 3 is a perspective view of the union shown in FIG. 2;

FIG. 4 is an bottom view of an air valve located in the union;

FIG. 4*a* is a cross-section view of the air valve shown in FIG. 4;

FIG. 5 is a front view of the mask, and

Figure 6:
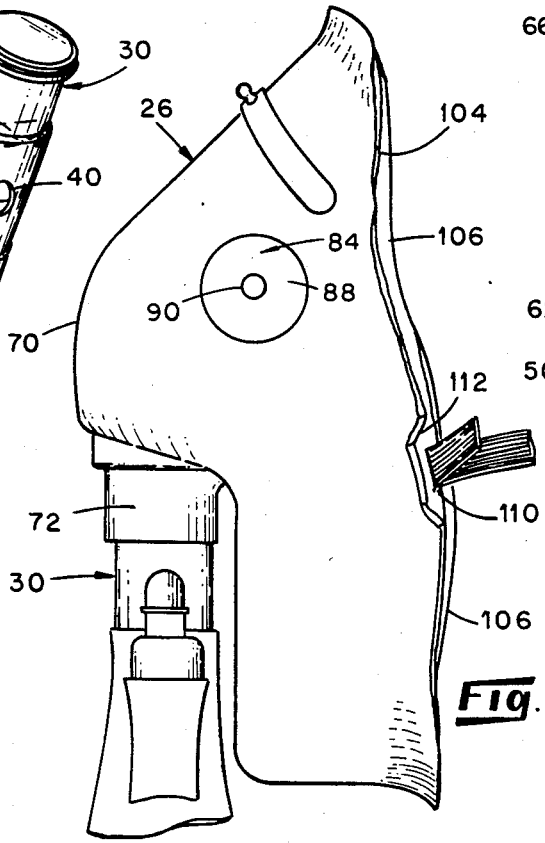

FIG. 6 is a side view of the mask shown in FIG. 5.

Figure 1:
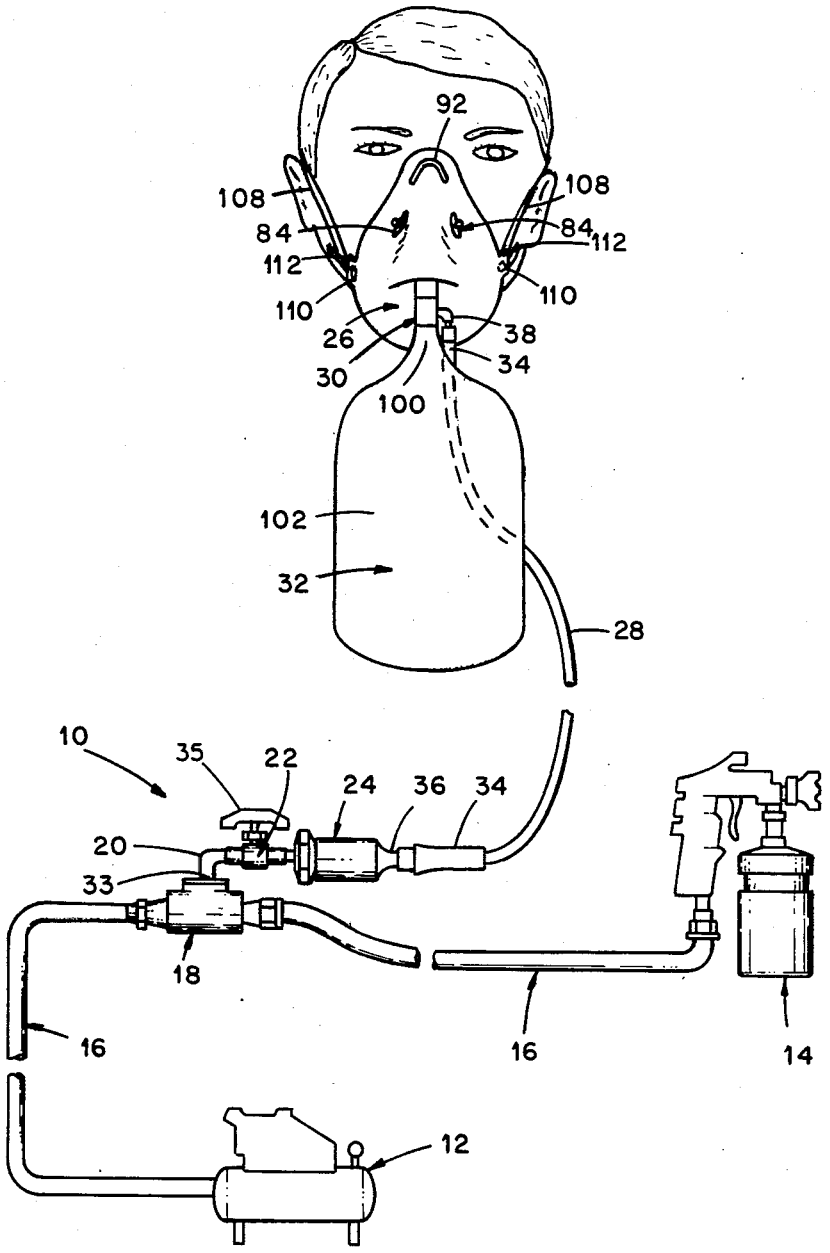
FIG. 1 is a schematic view of a preferred embodiment of the present invention illustrating a mask being worn by a painter, a bag attached to the mask, a delivery tube for delivering improved quality air to the mask, a filter, a valve, and a supply tap for removing air from the compressed air line.

Referring now to the drawings in which like reference characters refer to like or similar parts throughout the several views, there is illustrated in FIG. 1 a preferred embodiment of the present invention 10. The supplied air respirator system 10 is shown incorporated into a pre-existing compressor/paint sprayer arrangement with the compressor 12 and paint sprayer 14 being connected by a compressed air line 16. A T-shaped connector 18 is interposed in the air line 16 proximate to the paint sprayer 14 which in most applications would be 3 to 4 feet from the paint sprayer 14. Air is withdrawn from the connector 18 by an elbow tap 20 sealingly attached to the approximate center of the connector 18. The tap 20 is to be oriented so that it remains vertically above the connector 18 during use. This substantially reduces the tendency of particles flowing through the air line 16 to be drawn into the tap 20. A valve 22 extending horizontally from the tap 20 is configured so that it can be controlled by one hand of the painter while he uses the other hand to control the paint sprayer 14. The vlave 22 is sized to selectively admit more air into the system 10 than is required by the painter for breathing so that an excess of air can be maintained in the mask 26.

A filter 24 extends from the valve 22 to remove any particulates passing through the valve 22 and for reducing the pressure of the air. Filtered air is then passed to a mask 26 by a delivery tube 28. Before entering the mask 26, the air passes through a union 30 where its flow is diverted downward so that any suspended or entrained particles or condensate will be deposited in a bag 32 extending down from the front of the mask 26. Then, the air enters the mask 26 for being breathed by the painter using the paint sprayer 14.

It should be noted that in paint sprayers which utilize compressed air, it is usually required that the air be of a fairly high quality before it enters the sprayer as water or oil in the compressed air would greatly reduce the quality of a paint job. Thus, the air entering the sprayer is already fairly clean. But small amounts of impurities and oil do occasionally pass through the air line 16 making it necessary to condition the air before it is breathed. Accordingly, the present invention utilizes the vertically located elbow tap 20 combined with a particulate filter 24 and condensate bag 32 to insure proper conditioning of the air before it enters the mask 26 to be breathed by the painter. Moreover, by virtue of the restrictive effect of the valve 22 and filter 24, the pressure of the air is reduced from the forty to fifty pounds per square inch pressure of the air line 16 to a pressure suitable for maintaining a comfortable excess of air in the mask 26; i.e., about ten pounds per square inch.

In operation, a painter using the paint sprayer 14 would be holding the spraying 14 with one hand while using the other to hold the air line 16 near the connector 18. The painter orients his hand near the connector 18 so that he can manipulate the valve 22 with his thumb to maintain the desired air flow into the mask 26. And the amount of air used in the mask 26 is negligible in comparison to that used in the paint sprayer 14 so that use of the system 10 has no noticeable effect on the availability of air to the sprayer 14.

As noted above, placement of the tap 20 in the manner illustrated in FIG. 1 substantially reduces the likelihood that particles passing through the connector 18 will be drawn into the system 10. This is because the air enters the tap 20 from an outlet 33 in the connector 18 vertically above and perpendicular to the path of air travel in the connector 18. Air entering the tap 20 must make a ninety degree change in direction from its initial movement through the connector 18 and move upwardly. Since the weight of any particle flowing through the connector 18 is likely to be substantially greater than that of the air molecules, the momentum of the particles will carry them past the entrance to the tap 20 before they have a chance to be drawn into the tap 20 with the air. Of course, considering only momentum effects, this result would generally obtain regardless of whether the tap 20 was vertically above or below the connector 18. But by orienting the tap 20 vertically above the connector 18, advantage is taken of the gravitational effect on the moving particles which further lessens their tendency to be drawn into the tap 20. Thus, even the initial movement of air into the system 10 is accompanied by a substantial reduction in the amount of entrained particulate matter present in the air to be delivered to the painter.

After passing into the tap 20, the air flows into the valve 22 where it is regulated by the painter to achieve the desired flow of air into the mask 26. A preferred means for actuating the vlave 22 is provided by a T-shaped handle 35 connected to the valve 22 for regulating the flow of air through the vlave 22. The handle 35 is located proximate ot the connector 18 so that a painter can hold the spray unit 14 in one hand, and use the other hand to hold the connector 18 and air line 16 using the thumb of this other hand to manipulate the handle 35. Flowing out of the valve 22, the air passes through the filter 24 which contains wire mesh that substantially removes any remaining particulates from the air. The filter 24 also imposes a pressure reduction to further condition the air before it enters the mask 26.

After passing out of the filter 24, the air is directed to the mask 26 by the delivery tube 28 which is suitably provided by clear flexible tubing having an approximate seven foot length and an inner diameter of one quarter of an inch. It is preferred that the delivery tube be clear so that the painter can observe the air being supplied to his mask 26. Flexible female connectors 34 extend from each end of the tube 28. A male nipple 36 extending from the filter 24 is sealably received by one of the female connectors 34. An elbow connector 38 extends out of the union 30 at the front of the mask 26 to be received by the other female connector 34.

Referring now to FIG. 2, the union 30 is illustrated in cross-section removed from the mask 26. The upper end of the elbow connector 38 enters the union 30 on the side of the union 30 through an aperture 40. The end of the elbow connector 38 entering the union 30 has an annular circumferential depression 42 formed on its outer surface. The diameter at the innermost part of the depression 42 is approximately equal to the diameter of the aperture 40. And, as can be seen, the tip of the end of the elbow 38 that enters the aperture 40 is beveled so that its diameter at the end is less than the diameter of the aperture 40. To facilitate inserting the tip of the elbow 38 into the union 30, the union 30 is constructed of a plastic material flexible enough to deform somewhat as pressure is applied to force the tip of the elbow 38 into the aperture 40. Thus, when the tip of the elbow 38 is pushed into the aperture 40, the latter deforms as the diameter of the beveled edge on the end of the elbow 38 increases. When the annular depression 42 reaches the aperture 40, the aperture 40 returns to its original size sealably engaging the inner surface of the depression 42 to prevent air leakage out of the union 30. Also shown in FIG. 2 are a plurality of circumferential ribs 44 formed on the outer surface of the elbow 38 on the end of the elbow 38 received by the female connector 34. The ribs 38 aid in holding the connector 34 on the end of the elbow 38 which is formed on its ribbed end with a decreasing diameter to facilitate an engaging fit between the connector 34 and the elbow 38. The connector 34 provides a good seal at normal operating pressures (5–10 p.s.i.) but is sufficiently flexible so that it will blow off the ribs 44 at unacceptably high pressures (15–20 p.s.i.). Thus, the connector 34 provides a safety function as well as its primary function as a connector.

Referring to FIGS. 2 and 2*a* in conjunction with FIG. 3, a deflector plate 46 is shown formed within the union 30 adjacent the entrance of the elbow 38 into the aperture 40. The plate 46 is oriented so that its planar surface traverses the diameter of the union 30 and is preferably perpendicular to the direction of flow of air out the end of the elbow 38. It is seen that as air enters the union 30, the air is prevented form flowing up by a hemishperically shaped barrier 48 formed on the top of the deflector plate 46. Thus, air entering the union 30 must flow down and around the deflector 46 before entering the mask 26. As a result, any condensate or particles entering the union 30 from the elbow 38 will tend to fall into the bag 32 rather than be entrained in air moving up through the union 30 into the mask 26.

Referring now to FIG. 2 in conjunction with FIGS. 4 and 4*a*, an air inlet valve 50 is shown in the top end of the union 30. The air valve 50 is operable to automatically open to admit air into the mask 26 from the union 30 and to automatically close to prevent air from flowing out of the mask 26 into the union 30. This is accomplished by means of a flexible disc 52 attached to the top of the valve 50. Air moving up through the valve 50 pushes the outer part of the flexible disc 52 up and away from the valve 50 allowing unrestricted flow into the mask 26. Air moving from the mask 26 into the union 30 pulls the disc 52 down against the upper part of the valve 50 to close the valve 50.

The disc 52 has a small opening 54 formed in its center and is secured on the valve 50 by placing the disc 52 with the opening 54 over a knob 56 formed in the center of the valve 50 having a diameter greater than that of the opening 54. The disc 52 is pushed down so that the knob 56 enters the opening 54 stretching it until the opening 54 reaches a neck 58 formed on the knob 56 which has a diameter slightly less than that of the opening 54. A plurality of fins 60 extending from the knob 56 aid in preventing displacement of the disc 52 from the valve 50 as air is moving up through the valve 50.

As can be seen in FIG. 4, the knob 56 is supported in the center of the valve 50 by a triad of spoked support members 62 that are spaced apart 120 degrees. Air is therefore free to flow past the support members 62 when the valve 50 is open. Also shown in FIG. 4 are a plurality of support tabs 64 which aid in supporting the disc 52 when it is down against the upper surface of the support members 62. This would be the closed position of the valve 50 and the effect of the support members 62 and the support tabs 64 is to prevent the disc 52 from being displaced down into the valve 50 when pressure is applied against the upper surface of the disc 52.

A circumferential rim 66 formed around the upper edge of the valve 50 limits the movement of the valve 50 down into the union 30. And the diameter of the valve 50 below the rim 66 is approximately equal to the diameter of the union 30 at its top so that when the valve 50 is inserted into the union 30 there results an interference fit preventing movement of the valve 50 out of the union 30 except by means of manual displacement. Also, the diameter of the rim 66 is slightly less than the outside diameter of the union 30 at its top so that the valve 50 does not interfere when the union 30 is inserted into the mask 26.

With reference now to FIGS. 5 and 6, the mask 26 is shown with the union 30 inserted and the bag 32 attached to the lower end of the union 30. It is seen that the union 30 has a terraced outer surface having three distinct outer diameters. An upper outer surface 68 has the smallest outer diameter and is that part of the union 30 to be inserted into the mask 26. As best seen in FIGS. 5 and 6, a front nose portion 70 of the mask 26 has an integrally formed cylindrical receiver 72 extending downwardly to receive the union 30. The inner diameter of the receiver 72 is approximately equal to the outer diameter of the upper outer surface 68 of the union 30 so that there is an interference fit when the union 30 is inserted into the mask 26. An upper shoulder 74 limits movement of the union 30 into the mask 26 and forms the junction between the upper outer surface 68 of the union 30 and a middle outer surface 76 where the aperture 40 is located. It is seen that the outer diameter of the union 30 increases from surface 68 to surface 76, and further increases at a lower shoulder 78 where a lower outer surface 80 extends to the bottom of the union 30. A lip 82 extends around the bottom of the union 30, and the lower shoulder 78 and the lip 82 combine to help prevent the bag 32 from sliding down off the union 32.

A preferred means for exhausting air out of the mask 26 is provided by a pair of exhaust valves 84 located on opposite sides of the nose portion 70 of the mask 26. It should be noted that the exhaust valves 84 are located near the painter's eyes and that exhaust air leaving through the valves 84 will tend to clear the air around the painter's face, particularly, around his eyes. The valves 84 are operable to automatically open to allow air to exit the mask 26 and to automaticaly close to prevent outside air from entering the same principle as the air inlet valve 50. Air flowing from inside the mask 26 to the outside through a plurality of apertures 86 located beneath flexible discs 88 pushes the discs 88 out away from the apertures 86 allowing relatively unrestricted flow. When no air is flowing, the discs 88 lay essentially flat to cover the apertures 86. Any air flowing from outside the mask 26 through the apertures 86 to the inside of the mask 26 causes the discs 88 to be sucked against the surface of the mask 26 completely covering the apertures 86. The discs 88 are placed over knobs 90 extending from the outer surface of the mask 26 in much the same manner as the disc 52 is placed on the knob 56 in the air inlet valve 50.

A suitable means for clamping the upper part of the mask 26 to hold it against the nose of the painter is provided by a deformable metallic strip 92 removably attached at its center to a bridge portion 94 of the mask 26. An oblong opening 96 having a wider and a narrower end is located in the approximate center of the strip 92 and is placed over a knob 98 extending from the bridge 94 of the mask 26 to hold the strip 92 in place. The opening 96 is dimensioned so that the knob 98 will pass through the wider end of the opening 96 but not the narrower end. This allows the strip 92 to be held in place on the mask 26 because after the knob 98 is placed through the wider end of the opening 96, the strip 92 is moved laterally until the knob 98 is positioned extending through the narrower end of the opening 96. In this position, the strip 92 cannot be dislodged from the mask 26 since the knob 98 cannot pass through the narrower part of the opening 96. After the painter puts the mask 26 on, he can tighten the bridge portion 94 against the upper part of his nose by pressing the opposite ends of the strip 92 against the mask 26. And the rigidity of the strip 92, notwithstanding its deformable properties, is sufficient to hold it in its deformed position to maintain a seal between the mask 26 and the contours of the painter's face around the upper part of his nose.

The bag 32 is shown in FIGS. 1 and 5 attached to the lower end of the union 30. A narrowed neck 100 at the upper end of the bag 32 is dimensioned to have a slightly larger diameter than the diameter of the lower end of the union 30. Below the neck 100, the bag 32 widens into its containment portion 102 which holds the condensate that is deposited therein as air enters the union 30. The capacity of the containment portion 102 is about one quart. A painter will probably remove and empty the bag 32 after only a small amount of condensate has been deposited in the bag 32 because if the bag 32 became full, the weight of it would make wearing the mask 26 uncomfortable. Experience has shown that condensate accumulates in the bag 32 at a very slow rate so that it is not necessary to remove and empty the bag 32 each time the system 10 is used.

The bag 32 is preferaby secured to the union 30 by applying a strip of adhesive tape around the upper end of the neck 100 with the adhesive part of the tape in contact with both the neck 100 and the union 30. This forms a seal which not ony prevents air leakage into the mask 26, but also helps keep the bag 32 inflated by the pressure of air entering the mask 26 which facilitates easier drainage of condensate down into the bag 32.

FIGS. 5 and 6 illustrate the shape of the mask 26 and FIG. 1 shows the mask 26 being worn by a painter. The mask 26 is preferably formed from soft clear plastic material to cover the nose and mouth of the painter. As best seen in FIGS. 5 and 6, the mask 26 has a flared outer edge 104 so that there is a rounded perimeter surface 106 in contact with the contours of the painter's face. Opposite ends of an elastic strap 108 are guided through slots 110 formed in tabs 112 extending from opposite sides of the mask 26. When the strap 108 is tightened, the rounded surface 106 adjacent the outer edge 104 of the mask 26 is pressed against the contours of the painter's face forming a seal.

In operation, it is preferred that the painter modulate the valve 22 so that a slight excess of air is flowing into the mask 26. Thus, air leaks out of the mask 26 around the painter's face. This feature insures that the painter does not inhale paint from the ambient air around the mask and, also, the leaking air helps clear the air around the painter's face and eyes. It also helps keep the exhaust valves 84 clear from any obstruction and generally insures a cleaner and steadier supply of fresh air.

Under normal operating conditions, the bag 32 will remain substantially inflated but will be slightly less pressurized when the painter inhales. If the painter rapidly inhales for any reason, the bag 32 may temporarily deflate slightly and supply the needed make-up air. Thus, the bag 32 operates as an air reservoir and buffer for the mask 26.

In modulating the air supply, the painter should hold the air line 16 and connector 18 so that the elbow tap 20 extends vertically upward out of the connector 18 for the reasons discussed above. He can then utilize his thumb to control the valve 22 while using his other hand to hold and control the paint spray unit 14.

After using the system for an extended period of time, e.g., 2 months or so, the filter 24 should be replaced to insure an adequate supply of air to the mask 26. If the air supply begins to diminish substantially before this time, the filter 24 should be replaced. If this happens, it may be a sign of deteriorating air quality from the compressor 12.

Although a particular embodiment of the invention has been described in the foregoing detailed description, it is understood that the invention is capable of numerous rearrangements, modifications and substitutions of parts without departing from the scope of the invention according to what is claimed below.

What is claimed is:

1. In combination with a hand-held paint spray unit for being used by a painter to apply a spray of paint to an item, and a source of compressed air connected to the paint spray unit by a compressed air line for delivering compressed air to the spray unit to power the spray unit, a supplied air respirator system comprising:

a supply tap located in the compressed air line for removing a supply of compressed air for delivery to the painter, said tap being located in the line proximate to the hand-held paint spray unit and configured to be oriented generally vertically above the air line so that the tendency of particles to be drawn into said tap is reduced;

a valve in fluid flow communication with said tap, said valve being configured to be controlled by the painter for selectively removing a supply of air from the compressed air line;

a delivery tube for delivering air to the painter from said tap, said valve being disposed in said delivery tube for controlling the flow of air from said tap through said delivery tube;

a filter located in said delivery tube for removing particulates out of the air to be delivered to the painter;

a mask in fluid flow communication with said delivery tube for being worn by the painter for receiving and containing within said mask the air delivered to the painter through said delivery tube;

a union inserted into said mask so that an inner part of said union extends into said mask and an outer part of said union extends out of said mask;

an aperture formed in said mask sealably receiving said inner part of said union into said mask;

said delivery tube being attached to said outer part of said union for delivering air into said union;

a bag sealably attached to the outer part of said union and hanging downwardly therefrom and said union inlcuding means for providing fluid flow communication between said mask, said bag, and said delivery tube in a manner causing fluid entering said union from said delivery tube to flow through said bag entering said mask, whereby particles and condensate in the air entering said union from said delivery tube is directed into said bag to substantially prevent the particles and condensate from being entrained in air flowing into said mask from said union;

a pair of exhaust valves located on said mask near the eyes of the painter operable to automatically open and allow air to exhaust therefrom out of said mask when the to pressure within said mask is greater than the pressure outside of said mask and to automatically close and prevent air outside of said mask from entering said mask when the pressure outside of said mask is greater than the pressure inside said mask, said exhaust valves being positioned on said mask so that air exhausting therefrom tends to clear the ambient air around the eyes and face of the painter; and an inhalation valve located in said union operable to open and allow air to enter said mask from said bag through said union pressure in said union is greater than the pressure in said mask and to close and prevent air inside said mask from entering said union and said bag when the pressure inside said mask is greater than the pressure in said union, whereby said inhalation valve and exhalation valves both open and allow flow therethrough when the pressure in said union exceeds the pressure in said mask and the pressure in said mask exceeds the pressure outside of said mask so that said valve may be employed to regulate the flow of air into said mask to obtain a desired excess of air flow in accordance with the painter's breathing requirement, and exhalation into said bag is substantially prevented.

2. The supplied air respirator system of claim 1 wherein said supply tap and valve comprises:

a connector disposed in said compressed air line;

an outlet disposed in said connector oriented at a right angle with respect to said connector;

a right angle elbow tap having one end sealingly attached to receive compressed air from said outlet and having a second end oriented generally parallel to the compressed air line, said valve being sealingly attached between said second end of said elbow tap and said delivery tube for regulating the air flow into said delivery tube;

actuation means connected to said valve for varying the flow through said valve; and said actuation means being located proximate to said connector so that a painter can hold the spray unit in one hand, hold said connector and air line in his other hand, and manipulate said actuation means with the thumb of said other hand.

3. The supplied Air Respirator system of claim 1, further comprising diverting means located in said union for diverting flow of filtered air entering said union from said delivery tube in the direction of said bag to further facilitate depositing of condensate into said bag.

4. In combination with a hand-held paint spray unit for being used by a painter to apply a spray of paint to an item, and a source of compressed air connected to the paint spray unit by a compressed air line for delivering compressed air to the spary paint unit to power the spray unit, a supplied air respirator system comprising:

a mask to be worn by the painter for receiving and containing in said mask the air delivered to the painter;

a union extending from said mask for passing air into said mask;

a bag sealably attached to said union, wherein said bag hangs from said union and said union includes diverting means configured to receive and contain condensate and particulates present in the air passing through said union into said mask and direct them into said bag;

a delivery tube in fluid flow communication with said union for delivering air to said union to be passed into said mask, said tube being constructed of a clear flexible material so that the painter can view the air supplied to the mask;

a filter located in said delivery tube for substantially removing particulates out of the compressed air to be delivered to said mask;

a valve located in said delivery tube for selectively admitting compressed air from the compressed air line into the delivery tube, whereby admitting compressed air into the tube causes air to pass through said filter where particulates are removed and the pressure of the air is reduced, after which the air passes through said delivery tube into said union where condensate in the air is deposited in said bag and the air passes into said mask;

said valve being sized to selectively admit more air into the system than is required by the painter for breathing so that an excess of air can be maintained in said mask;

said valve including a handle for varying air flow through said valve with said handle being disposed near the airline so that an painter can hold the airline with one hand and manipulate the handle with the thumb of said one hand; and exhaust valve means located in said mask and operable to open and exhaust air is out of the when the pressure inside the mask exceeds the pressure outside the mask and to close and prevent air from flowing into the mask when the pressure outside the mask exceeds the pressure inside the mask, said valve means being located proximate to the eyes of the painter so that the air around the face and eyes of the painter is at least partially cleared by the exhausted air; and inhalation valve means located in said union and operable to open and allow air to flow from said bag through said union when the pressure in said union exceeds the pressure in said mask and to close and prevent air from flowing from said mask into said union when the pressure in said mask exceeds the pressure in said union, whereby said inhalation and exhalation valve means both open and allow air flow therethrough when the pressure in said union exceeds the pressure in said mask and the pressure inside said mask exceeds the pressure outside of said mask so that said valve may be employed to regulate the flow of air into said mask to obtain a desired excess of air flow in accordance with the painter's breathing requirements, and exhalation into said bag is substantially prevented.

5. The supplied air respirator system of claim 4, wherein said diverting means comprises:

a deflector plate located in said union having a planar surface approximately perpendicular to the flow of air entering said union from said delivery tube; and a barrier plate disposed in said union to prevent air entering said union from flowing into said mask except by means of being first deflected in the direction of said bag by said deflector plate.

6. The supplied air respirator system of claim 4, further comprising an air tap in the compressed air line for removing a supply of compressed air from the line, said tap in fluid flow communication with said valve and located proximate to the hand-held paint spray unit, and configured to be oriented generally vertically above the air line so that the tendency of particles to be drawn into said tap is reduced.

* * * * *